US009072323B2

(12) United States Patent
Weber

(10) Patent No.: US 9,072,323 B2
(45) Date of Patent: Jul. 7, 2015

(54) ANTI-RIDING UNDERPANTS

(71) Applicant: Curtis Weber, Oklahoma City, OK (US)

(72) Inventor: Curtis Weber, Oklahoma City, OK (US)

(73) Assignee: Curtis Weber, Oklahoma City, OK (US)

( * ) Notice: Subject to any disclaimer, the term of this patent is extended or adjusted under 35 U.S.C. 154(b) by 73 days.

(21) Appl. No.: 13/790,179

(22) Filed: Mar. 8, 2013

(65) Prior Publication Data

US 2014/0250570 A1 Sep. 11, 2014

(51) Int. Cl.
*A41B 9/00* (2006.01)

(52) U.S. Cl.
CPC ..... *A41B 9/001* (2013.01); *A41B 2400/82* (2013.01)

(58) Field of Classification Search
USPC ..... 2/69, 78.1–78.3, 79, 241, 402, 403, 2/323, 326, 327
See application file for complete search history.

(56) References Cited

U.S. PATENT DOCUMENTS

| | | | | |
|---|---|---|---|---|
| 1,657,866 | A * | 1/1928 | Mooney | 2/462 |
| 2,166,012 | A | 7/1939 | La Maida | |
| RE21,624 | E | 11/1940 | Dann | |
| 2,450,168 | A | 9/1948 | Schwartz | |
| 2,501,900 | A * | 3/1950 | Herbener | 450/143 |
| 2,756,435 | A * | 7/1956 | Rose | 2/255 |
| 3,945,042 | A * | 3/1976 | Lobo | 2/467 |
| 4,154,183 | A * | 5/1979 | Nunez | 2/302 |
| 4,355,425 | A | 10/1982 | Jones et al. | |
| 4,451,934 | A * | 6/1984 | Gioello | 2/113 |
| 4,581,771 | A | 4/1986 | Williams | |
| 5,074,854 | A | 12/1991 | Davis | |
| 5,515,543 | A * | 5/1996 | Gioello | 2/69 |
| 6,543,062 | B1 | 4/2003 | Amsel | |
| 6,651,463 | B2 | 11/2003 | Bonnin | |
| 7,503,078 | B2 | 3/2009 | Bernard et al. | |
| 2006/0206993 | A1 | 9/2006 | Bonnin | |
| 2009/0320184 | A1* | 12/2009 | Schaefer | 2/405 |
| 2011/0296586 | A1* | 12/2011 | Jaros | 2/236 |
| 2012/0047619 | A1* | 3/2012 | Lambertz | 2/69 |

FOREIGN PATENT DOCUMENTS

| | | |
|---|---|---|
| EP | 1772069 | 4/2007 |

* cited by examiner

*Primary Examiner* — Shaun R Hurley
*Assistant Examiner* — Andrew W Sutton
(74) *Attorney, Agent, or Firm* — Novak Druce Connolly Bove + Quigg LLP

(57) ABSTRACT

An anti-riding undergarment having a waistband; at least one fabric portion, having a top portion attached to the waistband and a bottom portion divided into two leg portions; a seam extending vertically along a rear seat portion of the undergarment from a point on the fabric portion positioned between the two leg portions to the waistband; and one or more bands spanning the seam.

12 Claims, 5 Drawing Sheets

ANTI-RIDING UNDERPANTS

BACKGROUND OF THE INVENTION

1. Field of the Invention

The present disclosure relates generally to undergarments, and more specifically to undergarments with prevent uncomfortable creasing or riding-up.

2. Description of the Related Art

Information relevant to attempts to address similar problems can be found in the following references, which are not admitted to be prior art with respect to the present invention by inclusion in this section:

(1) U.S. Pat. No. 4,581,771, issued Apr. 15, 1986 to Williams;

(2) U.S. Pat. No. 7,503,078, issued Mar. 17, 2009, to Bernard et al.;

(3) U.S. Pat. No. 6,543,062, issued Apr. 8, 2003, to Amsel et al.;

(4) U.S. Pat. No. 6,651,463, issued Nov. 25, 2003, to Bonnin;

(5) U.S. Pat. No. 5,074,854, issued on Dec. 24, 1991 to Davis;

(6) US Patent Publication 2009/0320184 A1, filed Jun. 27, 2008, by Schaefer;

(7) US Patent Publication 2006/0206993 A1, filed Mar. 18, 2004, by Bonnin;

(8) EP 1772069 A2, filed Oct. 6, 2005, by Herbert et al.;

(9) U.S. Pat. No. 4,355,425, issued Oct. 26, 1982, to Jones et al.;

(10) U.S. Pat. No. 2,450,168, issued Sep. 28, 1948, to Schwartz;

(11) U.S. Pat. No. 2,166,012, issued Jul. 11, 1939, to T. L A Maida; and

(12) Re 21,624, issued Nov. 19, 1940, to Dann.

However, each one of these reference suffers from one or more of the following disadvantages, which are not admitted to have been known in the art by inclusion in this section: the devices require inserts, require removing an undergarment in pieces rather than the normal way of removing undergarment, merely improve aesthetics of wearers profile by accentuating the shape without providing for comfort, attempt to increase comfort by displacing the normal location of seams, attempt to increase comfort by providing an alternative to an undergarment altogether, merely attempt to solve problem of leg-parts of undergarments from folding and riding up; merely attempt to increase comfort of front portions of undergarments.

For the foregoing reasons, there is a need to prevent uncomfortable creasing of the rear seat of undergarments, also known as riding-up, or wedgie-ing, while being completely unnoticeable to the wearer, and also not affecting the overall shape of the body.

BRIEF SUMMARY OF THE INVENTION

The present invention is directed to an undergarment that satisfies the need to prevent uncomfortable creasing, also known as riding-up, or wedgie-ing, while being completely unnoticeable to the wearer, and also not affecting the overall shape of the body.

Various embodiments relate to an anti-riding undergarment having a waistband; at least one fabric portion, having a top portion attached to the waistband and a bottom portion divided into two leg portions; a seam extending vertically along a rear seat portion of the undergarment from a point on the fabric portion positioned between the two leg portions to the waistband; and one or more bands spanning the seam.

BRIEF DESCRIPTION OF THE DRAWINGS

These and other features, aspects, and advantages of the present invention will become better understood with reference to the following description and appended claims, and accompanying drawings where:

Figure 1:
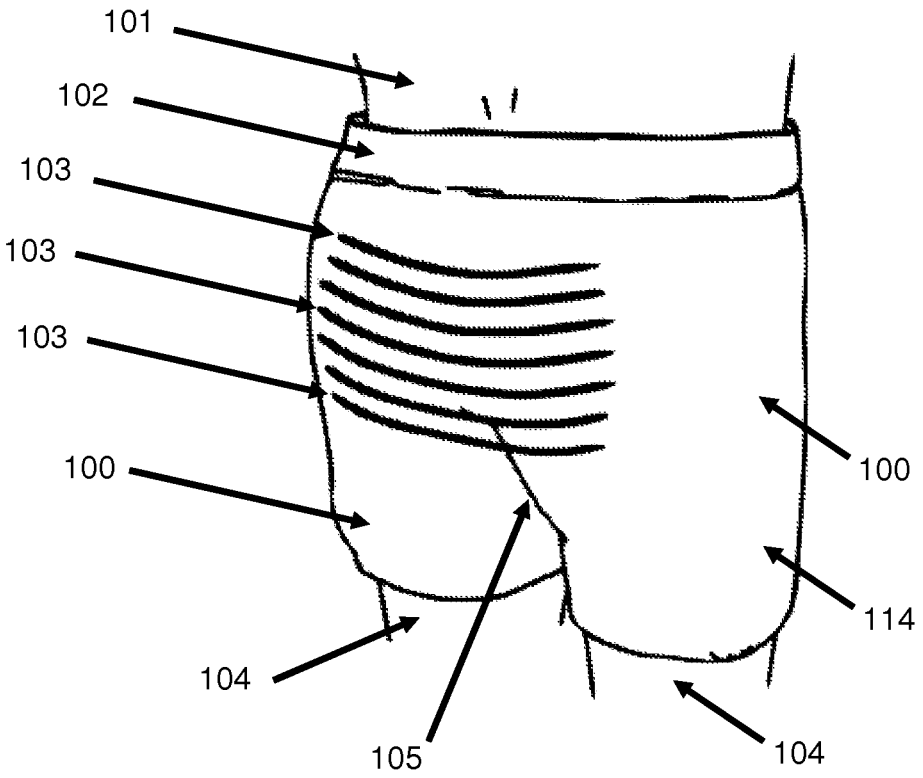
FIG. 1: shows a rear perspective view of an inventive undergarment.

It should be understood that the various embodiments are not limited to the arrangements and instrumentality shown in the drawings.

DETAILED DESCRIPTION OF THE INVENTION

The present invention may be understood more readily by reference to the following detailed description of preferred embodiments of the invention as well as to the examples included therein. All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Figure 2:
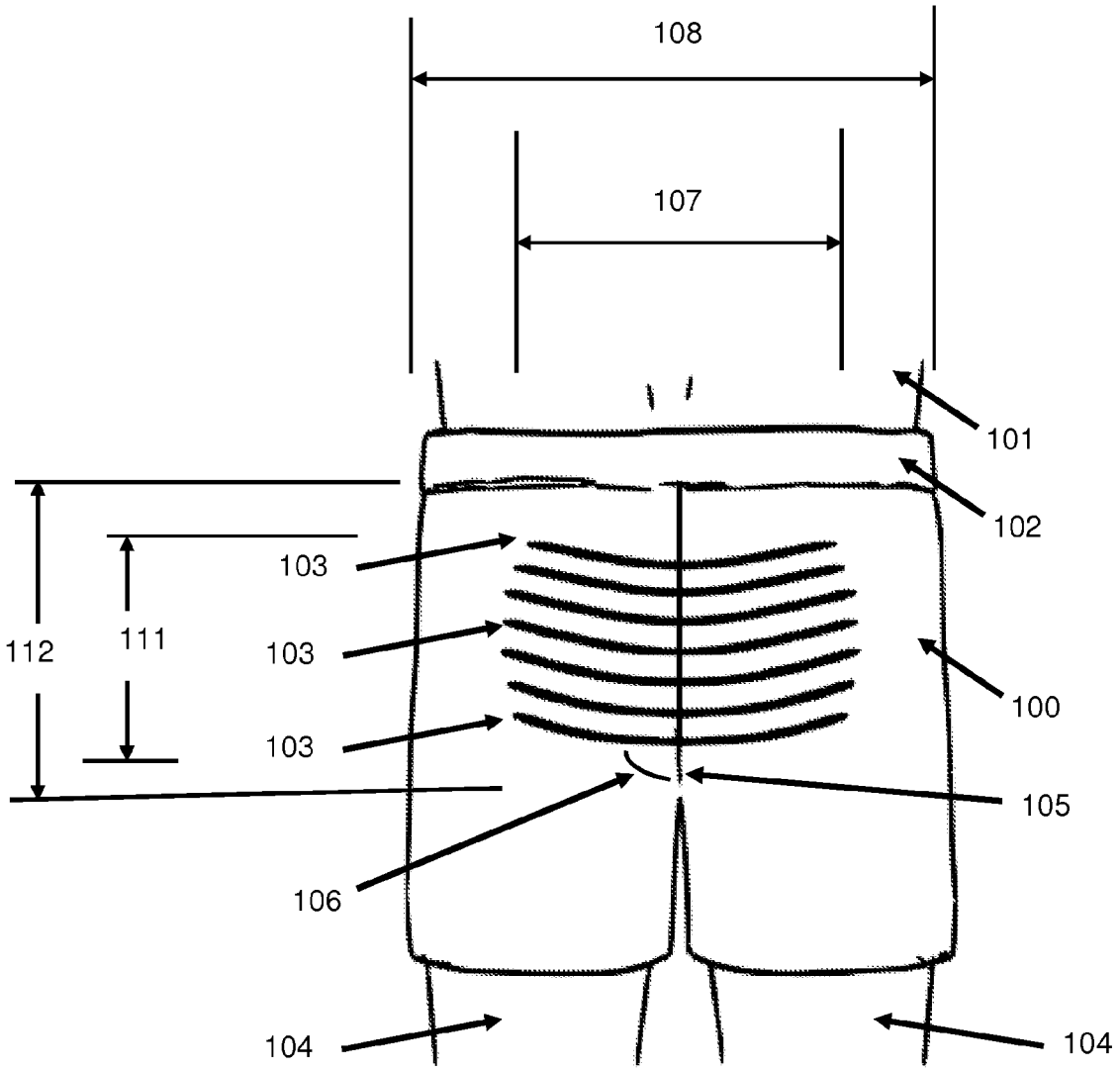
FIG. 2: shows a rear view of an inventive undergarment.
Figure 3:
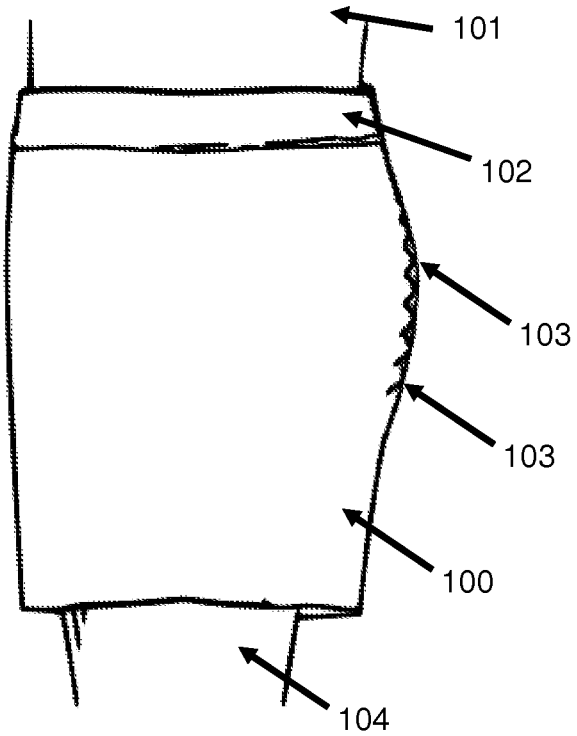
FIG. 3: shows a side view of an inventive undergarment.

Referring to FIGS. 1-3, an undergarment 100 is shown on the body of a user 101. The undergarment 100 includes at least one fabric portion 114, a waistband 102, and a seam 105. The seam 105 can be a portion of the undergarment 100 at which pieces of the at least one fabric portion 114 or a plurality of fabric portions overlap and are stitched together, or can simply be an axis along the seat of the undergarment, extending vertically from a point between the user's legs 104 to a central portion of the waistband 102. The undergarment 100 includes one or more bands 103.

As shown most clearly in FIG. 2, each of the one or more bands 103 can be positioned to span the seam 105. The one or more bands 103 span the seam 105 at an angle within a range having a lower limit and/or an upper limit. The range can include or exclude the lower limit and/or the upper limit. The lower limit and/or upper limit can be selected from 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, and 170 degrees. For example, according to certain preferred embodiments, the one or more bands 103 span the seam 105 at an angle of from 30 to 150 degrees. According to particularly preferred embodiments, the one or more bands 103 span the seam 105 at an angle of about 90 degrees. Each band 103 can span the seam 105 at the same angle as other bands 103, or at different angles compared to other bands 103.

As shown in FIG. 2, the one or more bands 103 can span a horizontal portion of the rear seat of the undergarment 100. The horizontal portion of the rear seat of the undergarment 100 spanned by the one or more bands 103 can have a distance 107 that can be a percentage of the overall width 108 of the rear seat of the undergarment 100. The distance 107 spanned by the one or more bands can be within a range having a lower limit and/or an upper limit. The range can include or exclude the lower limit and/or the upper limit. The lower limit and/or upper limit can be selected from 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, and 160% of the overall width 108 of the rear seat of the undergarment 100. For example, according to certain preferred embodiments, the distance 107 spanned by the one or more bands can be from 1 to 100% of the overall width 108 of the rear seat of the undergarment 100. According to certain preferred embodiments, the distance 107 spanned by the one or more bands can be about 80% of the overall width 108 of the rear seat of the undergarment 100. It should be understood that in embodiments where the distance 107 spanned by the one or more bands is greater than 100% of the overall width 108 of the rear seat of the undergarment 100, the one or more bands wrap around the side of the undergarment and, therefore, are not limited to the rear seat portion of the undergarment 100. Each band 103 can span a unique distance 107 of the rear seat of the undergarment 100 or each band 103 can span the same distance 107 of the rear seat of the undergarment 100.

As shown in FIG. 2, the one or more bands 103 can span a vertical portion of the seam 105. The vertical portion of the seam 105 spanned by the one or more bands 103 can have a distance 111 that can be a percentage of the overall length 112 of the seam 105. The distance 111 spanned by the one or more bands can be within a range having a lower limit and/or an upper limit. The range can include or exclude the lower limit and/or the upper limit. The lower limit and/or upper limit can be selected from 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, and 160% of the overall length 112 of the seam 105. For example, according to certain preferred embodiments, the distance 111 spanned by the one or more bands can be from 1 to 100% of the overall length 112 of the seam 105. According to certain preferred embodiments, the distance 111 spanned by the one or more bands can be about 80% of the overall length 112 of the seam 105.

It should be noted that a seam is not required. In embodiments where the undergarment 100 does not include a seam 105, the one or more bands can span a vertical portion of the rear seat of the undergarment corresponding to the location of a seam. The location of a seam can be the vertical distance from the waistband 102 to the crotch area of the undergarment, located at the point where the undergarment divides to accommodate the user's 101 legs 104.

The one or more bands 103 can take a variety of shapes, including but not limited to rectangular, trapezoidal, square, circular, and oval. Particularly preferred embodiments utilize rectangularly-shaped bands. The one or more bands 103 can be placed on the back panel or the rear seat portion of the undergarment 100 and can stretch such that they cover the gluteus maximus. To facilitate stretch ability of the bands 103, the bands can be include a variety of materials, such as cotton, polyester, nylon, plastic, polypropylene, elastic. It should be noted that as shown in FIGS. 1-2, the bands 103 are shown in a curved configuration. According to preferred embodiments, however, the illustrated curvature can be due to the elastic nature of the bands 103, which have a non-curved shape, such as a rectangular shape. Alternatively, the bands 103 can have a curved shape.

Figure 4:
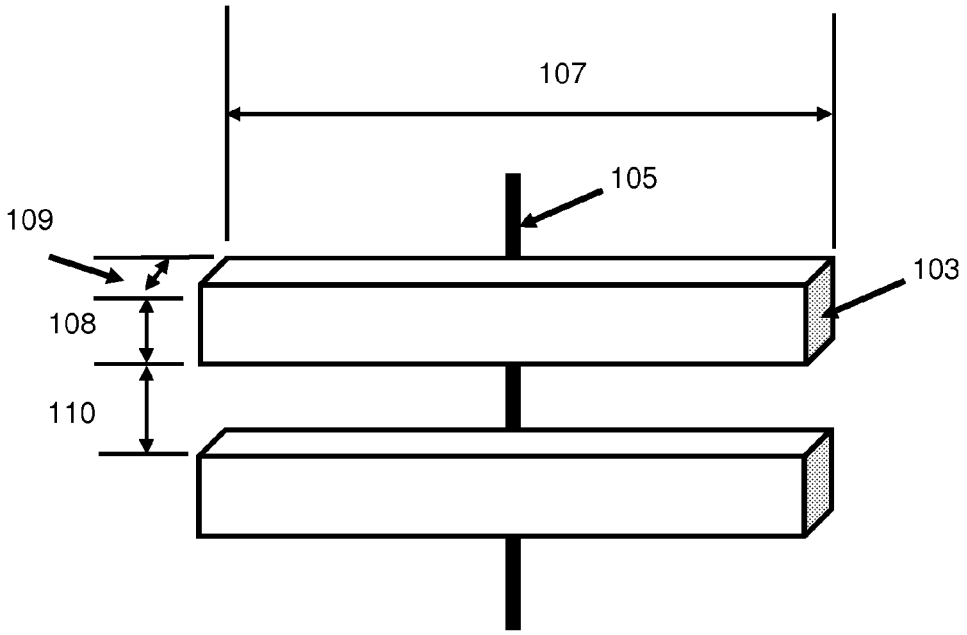
FIG. 4: shows a band according to various embodiments.

Referring to FIG. 4, the one or more bands 103 can have a height 108 extending along the seam 105 within a range having a lower limit and/or an upper limit. The range can include or exclude the lower limit and/or the upper limit. The lower limit and/or upper limit can be selected from 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, 4, 4.1, 4.2, 4.3, 4.4, 4.5, 4.6, 4.7, 4.8, 4.9, 5, 5.1, 5.2, 5.3, 5.4, 5.5, 5.6, 5.7, 5.8, 5.9, 6, 6.1, 6.2, 6.3, 6.4, 6.5, 6.6, 6.7, 6.8, 6.9, 7, 7.1, 7.2, 7.3, 7.4, 7.5, 7.6, 7.7, 7.8, 7.9, 8, 8.1, 8.2, 8.3, 8.4, 8.5, 8.6, 8.7, 8.8, 8.9, 9, 9.1, 9.2, 9.3, 9.4, 9.5, 9.6, 9.7, 9.8, 9.9, 10, 10.1, 10.2, 10.3, 10.4, 10.5, 10.6, 10.7, 10.8, 10.9, 11, 11.1, 11.2, 11.3, 11.4, 11.5, 11.6, 11.7, 11.8, 11.9, 12, 12.1, 12.2, 12.3, 12.4, 12.5, 12.6, 12.7, 12.8, 12.9, 13, 13.1, 13.2, 13.3, 13.4, 13.5, 13.6, 13.7, 13.8, 13.9, 14, 14.1, 14.2, 14.3, 14.4, 14.5, 14.6, 14.7, 14.8, 14.9, 15, 15.1, 15.2, 15.3, 15.4, 15.5, 15.6, 15.7, 15.8, 15.9, 16, 16.1, 16.2, 16.3, 16.4, 16.5, 16.6, 16.7, 16.8, 16.9, 17, 17.1, 17.2, 17.3, 17.4, 17.5, 17.6, 17.7, 17.8, 17.9, 18, 18.1, 18.2, 18.3, 18.4, 18.5, 18.6, 18.7, 18.8, 18.9, 19, 19.1, 19.2, 19.3, 19.4, 19.5, 19.6, 19.7, 19.8, 19.9, and 20 cm. For example, according to certain preferred embodiments, the one or more bands 103 can have a height 108 extending along the seam 105 of from 4 to 10 cm.

Still referring to FIG. 4, the one or more bands 103 can have a thickness 109 within a range having a lower limit and/or an upper limit. The range can include or exclude the lower limit and/or the upper limit. The lower limit and/or upper limit can be selected from 0.001, 0.005, 0.01, 0.015, 0.02, 0.025, 0.03, 0.035, 0.04, 0.045, 0.05, 0.055, 0.06, 0.065, 0.07, 0.075, 0.08, 0.085, 0.09, 0.095, 0.1, 0.105, 0.11, 0.115, 0.12, 0.125, 0.13, 0.135, 0.14, 0.145, 0.15, 0.155, 0.16, 0.165, 0.17, 0.175, 0.18, 0.185, 0.19, 0.195, and 0.2 cm. For example, according to certain preferred embodiments, the one or more bands 103 can have a thickness 109 of from 0.001 to 0.01 cm. The thickness can be adapted to be thin and flat so the bands 103 do not create discomfort while the user 101 is sitting.

The undergarment 100 can include a number of bands 103 within a range having a lower limit and/or an upper limit. The range can include or exclude the lower limit and/or the upper limit. The lower limit and/or upper limit can be selected from 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, and 110. For example, according to certain preferred embodiments, the undergarment 100 can include a number of bands 103 in a range of from 6 to 10.

The one or more bands 103 can be spaced relative to one another at a distance 110 within a range having a lower limit and/or an upper limit. The range can include or exclude the lower limit and/or the upper limit. The lower limit and/or upper limit can be selected from 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, 4, 4.1, 4.2, 4.3, 4.4, 4.5, 4.6, 4.7, 4.8, 4.9, 5, 5.1, 5.2, 5.3, 5.4, 5.5, 5.6, 5.7, 5.8, 5.9, 6, 6.1, 6.2, 6.3, 6.4, 6.5, 6.6, 6.7, 6.8, 6.9, 7, 7.1, 7.2, 7.3, 7.4, 7.5, 7.6, 7.7, 7.8, 7.9, 8, 8.1, 8.2, 8.3, 8.4, 8.5, 8.6, 8.7, 8.8, 8.9, 9, 9.1, 9.2, 9.3, 9.4, 9.5, 9.6, 9.7, 9.8, 9.9, and 10 cm. For example, according to certain preferred embodiments, the one or more bands 103 can be spaced relative to one another at a distance 110 of from 2 to 5 cm. According to certain preferred embodiments, the bands 103 are spaced by distance 110 and are not connected to allow for better curvature, which aids in comfort during sitting or other activities.

The one or more bands 103 can be secured to the undergarment 100 in a variety of ways. For example, the bands can be subjected to heat and have acetone applied until it meshes with the fabric.

Figure 5:
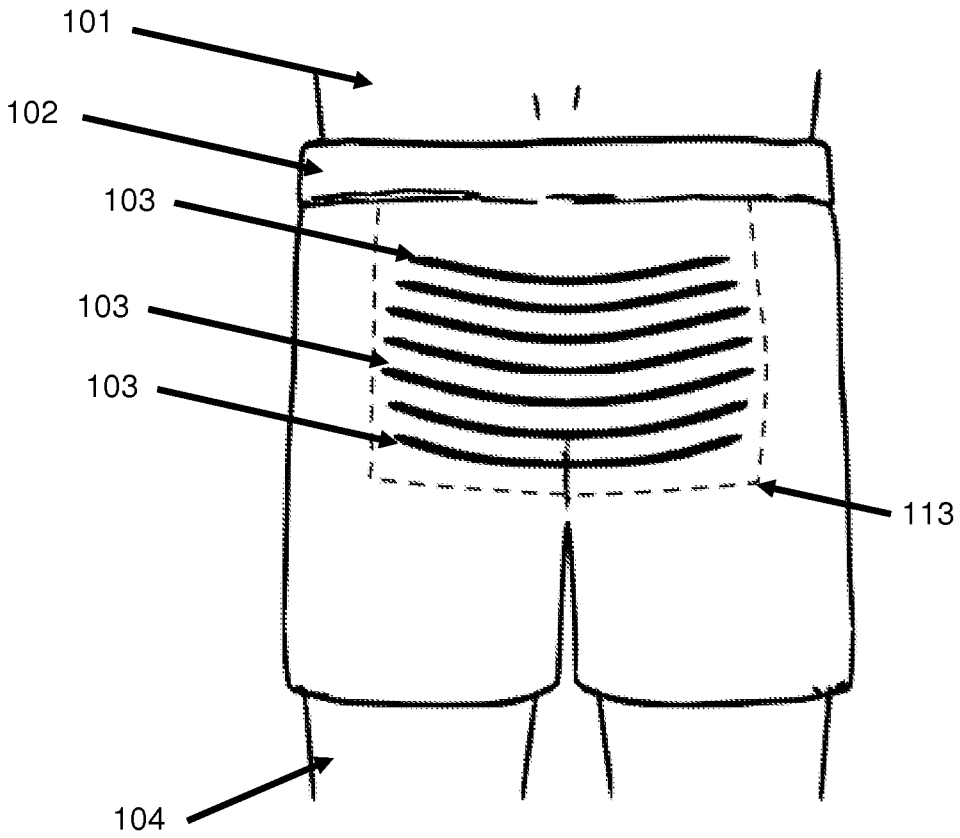
FIG. 5: shows a pocket according to various embodiments.

As illustrated in FIG. 5, the back panel can have a stitched non-accessible pocket 113 to encompass one or more bands 103. The bands can be laid out onto the back panel, and then the pocket 113 can be placed on top of the bands, and then sewn shut. This option ensures that the wearer is not subjected to the texture of the bands, but rather the fabric of the pocket 113, which wearers are accustomed to.

Although the present invention has been described in considerable detail with reference to certain preferred versions thereof, other versions are possible. Therefore, the spirit and scope of the appended claims should not be limited to the description of the preferred versions contained herein.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An anti-riding undergarment comprising a waistband;

at least one fabric portion, having a top portion attached to the waistband and a bottom portion divided into two leg portions;

a seam extending vertically along a rear seat portion of the undergarment from a point on the fabric portion positioned between the two leg portions to the waistband; and one or more elastically-deformable bands spanning the seam, wherein the one or more bands span a horizontal portion of the rear seat of the undergarment, the horizontal portion having a distance that is from 50-80% of an overall width of the rear seat of the undergarment, wherein the one or more bands span a vertical portion of the seam, the vertical portion having a length of from 10-80% of an overall length of the seam, and wherein the one or more bands have a thickness of from 0.001 to 0.01 cm.

2. The anti-riding undergarment according to claim 1, wherein the one or more bands span the seam at an angle of from 30 to 150 degrees relative to the seam.

3. The anti-riding undergarment according to claim 1, wherein each band has a unique length.

4. The anti-riding undergarment according to claim 1, wherein each band has the same length.

5. The anti-riding undergarment according to claim 1, wherein the one or more bands can have a height extending along the seam of from 4 to 10 cm.

6. The anti-riding undergarment according to claim 1, wherein the undergarment comprises from 6 to 10 bands.

7. The anti-riding undergarment according to claim 1, wherein the one or more bands can be spaced relative to one another at a distance of from 2 to 5 cm.

8. The anti-riding undergarment according to claim 1, wherein the one or more bands have a shape selected from the group consisting of rectangular, trapezoidal, square, circular, oval, and combinations thereof.

9. The anti-riding undergarment according to claim 1, wherein the bands comprise a material selected from the group consisting of cotton, polyester, nylon, plastic, polypropylene, elastic, and combinations thereof.

10. The anti-riding undergarment according to claim 1, wherein the rear seat portion of the undergarment further comprises a pocket to encompassing the one or more bands.

11. The anti-riding undergarment according to claim 1, wherein the seam comprises overlapping fabric segments of the at least one fabric portion.

12. The anti-riding undergarment according to claim 1, wherein the seam is a vertical axis extending along the rear seat portion of the undergarment.

* * * * *